United States Patent [19]

Peacock

[11] Patent Number: 4,592,519

[45] Date of Patent: Jun. 3, 1986

[54] HOSE ROLLER

[76] Inventor: Roy A. Peacock, 239 Tarpon St., Tavernier, Fla. 33070

[21] Appl. No.: 650,451

[22] Filed: Sep. 14, 1984

[51] Int. Cl.[4] ..... B65H 75/40

[52] U.S. Cl. ..... 242/86

[58] Field of Search ..... 242/86, 86.1, 86.2

[56] References Cited

U.S. PATENT DOCUMENTS

| | | | |
|---|---|---|---|
| 1,089,265 | 3/1914 | Ridley | 242/86.2 |
| 1,799,599 | 4/1931 | Moore | 242/86 |
| 2,960,279 | 11/1960 | Little | 242/86.1 |
| 3,124,321 | 3/1964 | Rylott et al. | 242/86.2 |
| 3,168,260 | 2/1965 | Kittleson | 242/86 X |
| 3,471,885 | 10/1969 | McLoughlin | 242/86 X |
| 4,198,010 | 4/1980 | Knapp | 242/86.2 |
| 4,475,698 | 10/1984 | Militello | 242/86 |

*Primary Examiner*—Stuart S. Levy
*Assistant Examiner*—Lloyd D. Doigan
*Attorney, Agent, or Firm*—Malin, Haley & McHale

[57] ABSTRACT

A hose roller device used to roll up collapsed hose, such as fire hose. The hose roller device includes a two pronged fork on which the collapsed hose is placed and rolled up into a uniform roll that can be easily removed from the two prongs for storage or transportation in the rolled condition. The two pronged fork is attached to one end of an axle that is rotatably held in a transverse bearing hole through an upright member. A crank handle is connected to the other end of the axle to roll up the hose. The member is held upright by a support system that fixes the vertical position. The support system allows the member to rotate about this longitudinal vertical centerline. The member extends above the two pronged fork and includes a fitting to which a tiller is connected. The tiller may be placed into either of two positions to accommodate a right or left handed person. The tiller is used steer hose roller device. The hose roller is designed to be mounted permanently in the ground or in concrete or removably mounted on a vehicle such as a fire apparatus.

2 Claims, 4 Drawing Figures

Fig. 3.
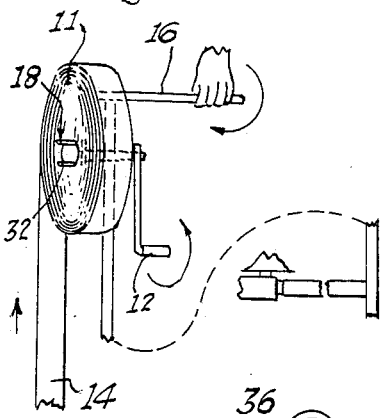
Fig. 4.
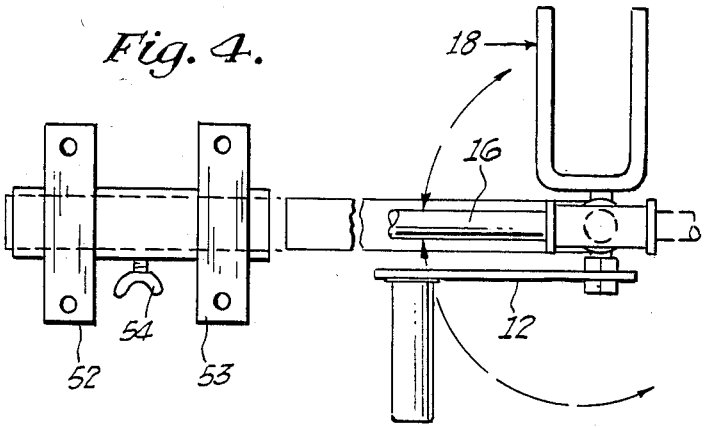
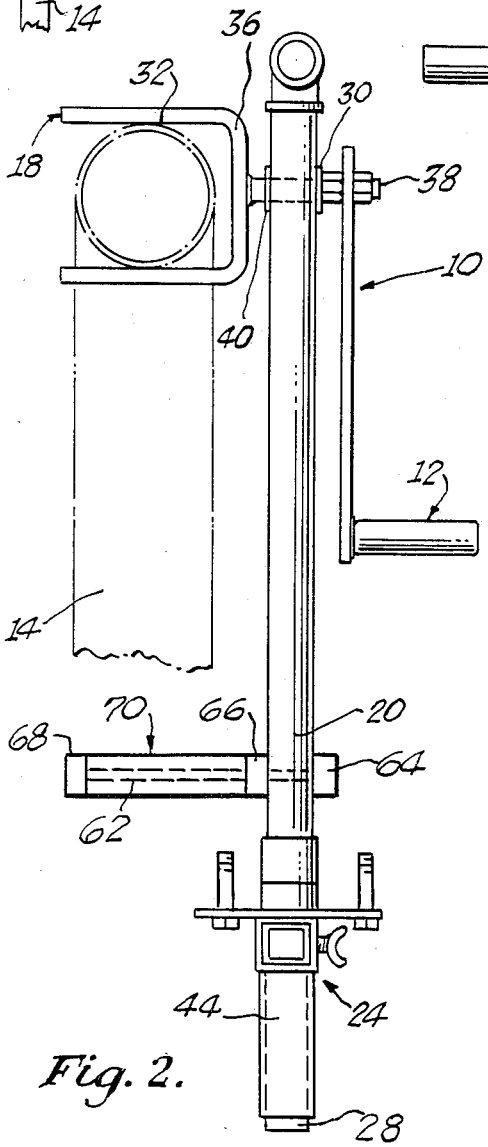
Fig. 2.
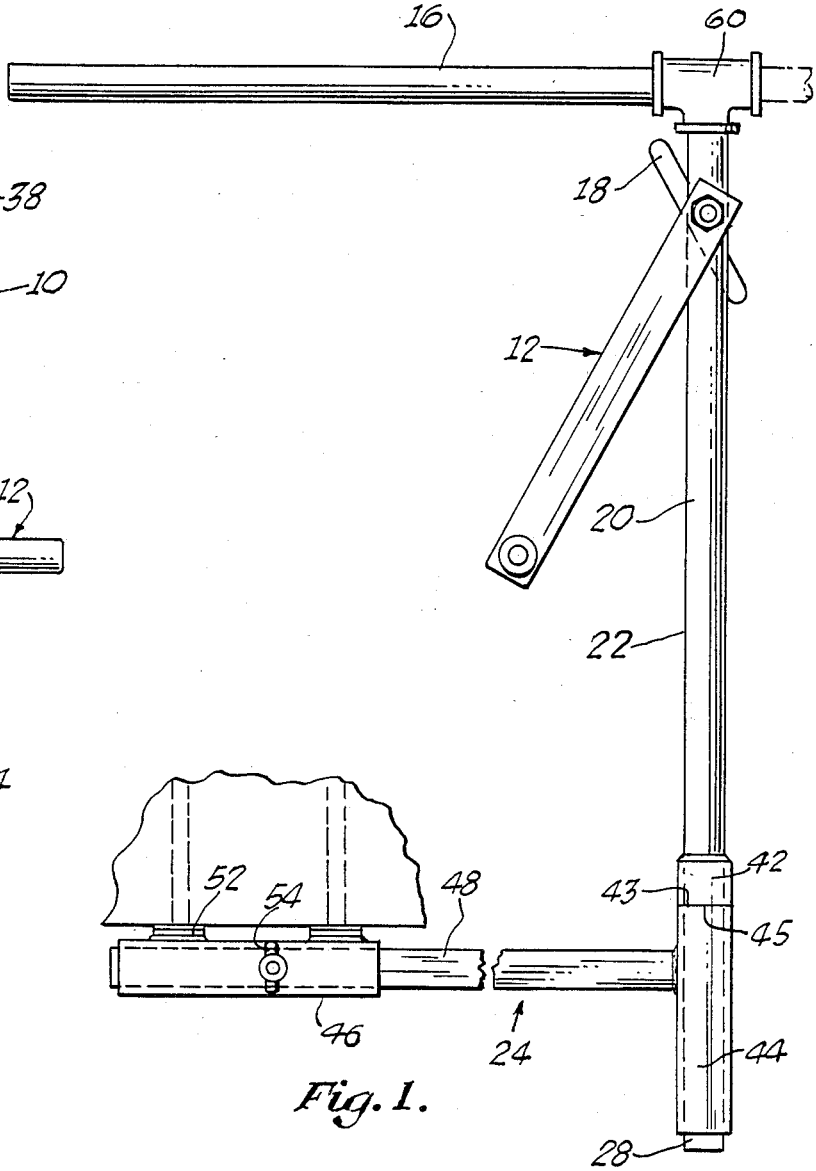
Fig. 1.

HOSE ROLLER

BACKGROUND OF THE INVENTION

This invention relates to a new and improved hose roller device that is steerable, and allows a collapsed hose laying haphazardly on the ground to be rolled up on the hose holder and easily pulled off the hose holder for reuse or storage.

In the past various types of portable reels and hose rollers have been constructed and designed. Such devices are described in U.S. Pat. Nos. 3,946,964; 4,288,047; 2,717,129; 3,779,478 and 3,722,823. Each of these devices have side members that prevent the hose roll from being easily pulled off the hose holder on the hose roller. Further, the prior art does not disclose a non-complex steerable hose roller device that can roll up a collapsed hose laying haphazardly on the ground. All the prior art devices are complex in construction and design and do not provide the practical and useful device disclosed herein by the applicant.

BRIEF DESCRIPTION OF THE INVENTION

This invention is a new and improved hose roller device. The hose roller device is used to roll up collapsed hose, such as fire hose that need not be positioned in a straight line on the ground. The hose roller device may be operated by a hand crank or a motor. The hose or a hose fitting is initially connected to a hose holder. The hose holder is connected to the hand crank or motor. The hose holder is rotated to roll up a collapsed hose into a uniform roll. The hose may be rolled up from one end or it may be rolled up from the center of the hose. The hose holder is free to one side. No obstructions are found adjacent a side of the hose holder. Therefore the rolled up hose may be pulled off of the hose holder in the form of a donut for storage or use. The hose holder is held by a long vertical member rotatable about its longitudinal center line. The vertical member may be rotated about its longitudinal center line into a proper position to position the hose holder to roll up a portion of a collapsed hose. A tiller connected to the vertical member is used to stear the hose roller device. The vertical member may be held in position by a support system in the ground, deck or on a vehicle. The support system is connected to a lower portion of the vertical member.

The hose roller device includes a generally vertical member having its longitudinal center line, an upper portion with an axle opening, a lower portion. The hose roller device also includes the tiller and the hose holder. The hose holder includes a fork with open ends and a closed end, and an axle connected at one end to the closed end of the fork. The hose holder also includes a bearing that is positioned in the axle opening of the vertical member. The axle is positioned for rotation in the bearing. A drive means is connected to the other end of the axle. The drive means may be a crank handle or the drive means may be an electric motor powered by batteries or another source of electricity. Other power sources may be used. The vertical member also includes a support means positioned just above the lower portion. The generally vertical member is positioned for rotatable movement about the longitudinal center line and is supported on the support means that acts as a bearing surface. A support system includes a mating support means and an opening in the mating support means for passage of the lower portion of the generally vertical member below the mating support means. The support means and the mating support means have a ring shaped contact face that act as bearing surfaces. The support system includes a permanent receiver mount connectable to a vehicle, a mount member connected to the mating support means and releasably connectable to the mount member is slideably engageable into the receiver mount. Bolts are used to removably connect the mount member in the receiver mount. Other support systems may be used such as placing the mating support means in a hole in the ground or in a concrete block to support the hose roller device.

BRIEF DESCRIPTION OF THE DRAWING

In the drawing:

FIG. 1 is a side view of the hose roller device.

FIG. 2 is a front view of the hose roller device as shown in FIG. 1 except that the fork and crank handle are in a different position.

FIG. 3 is an isometric view of the receiver mount.

FIG. 4 is a top view of a portion of the hose holder.

DESCRIPTION OF THE PREFERRED EMBODIMENT

Referring now to the drawing, the invention is to a new and improved hose roller device 10 is shown in FIGS. 1 through 4. The hose roller device 10 is used to roll up into a roll 11 a collapsed hose 14, such as fire hose that need not be positioned in a straight line on the ground. The hose roller device 10 may be operated by a hand crank 12 or a motor (not shown). The collapsed hose 14 illustrated in phantom in FIG. 2 and shown in FIG. 3 is initially connected to a hose holder 18. In FIGS. 2 and 4 the fitting on one end of the hose is connected between forks 32. The hose holder 18 is rotated to roll up a collapsed hose 14 into a uniform roll, as shown at 11 in FIG. 3. The hose holder 18 has no obstructions on its left sides as shown in FIGS. 2 and 4 and therefore the roller up hose may be pulled off of the hose holder when a force is applied in the direction of arrow A. The rolled up hose may then be used or placed in storage. The hose holder 18 is held in position by a generally vertical member 20. The vertical member 20 is rotatable about its longitudinal center line 22. The vertical member 20 may be rotated into a proper position to roll up a portion of a collapsed hose laying haphazardly on the ground by a tiller 16. The tiller may be connected to the member 20. The member 20 may be held in position by a support system 24 in the ground, on a deck or on a vehicle.

It should be noted that holder 18 includes two dowels 18' and 18" welded to base 36 (not shown). The hose roller device 10 includes member 20 which has a longitudinal central line 22, upper portion 26 with an axle opening 30 therein, and lower portion 28 that is connectable to the support system 24. A hose holder 18 includes a fork 18' and 18" with open ends 34 and a closed end 36, axle 38 connected at one end by a weld to the closed end 36 of the fork 32, and a bearing 40 positioned in the axle opening 30 and between member 20 and holder 18. An additional bearing 46 may be used. The axle 38 is positioned for rotation in the bearing 40. A drive means such as 12 is connected to the other end of the axle 38. The fastening means between the axle 38 and crank handle 12 may be a nut on a threaded axle. The drive means may be a crank handle 12 as shown or the drive means is an electric motor (not shown) or some other power source. A T-fitting 60 may be connected to the top of the vertical member 20. A tiller 16 with a threaded end may be connected into either side of the T-fitting 60. This feature shown in FIG. 1 allows a right or left handed person to easily use the hose roller device 10. An alternate tiller arrangement may be constructed by making a hole through the top of member 20 similar to hole 30 but 90 degrees from hole 30. Tiller 16 may be a rod with one enlarged end. This tiller (not shown) may be used as tiller 16.

The member 20 includes a support ring 42. This support ring or support means 42 is positioned above said lower portion 28. The member 20 is positioned for rotatable movement about the longitudinal center line 22. The member 20 is supported on surface 43 of the support means 42. The support system 24 has a mating support means 44 with a mating surface 45. The mating support means 44 has an opening in it for passage of the lower portion 28 of member 20. A part of the lower portion 28 is positioned beneath the mating support means 44.

The support system 24 includes a permanent receiver mount 72 shown in FIGS. 1, 2 and 4. The receiver mount 72 is connectable to a vehicle. Arms 52 and 53 are placed under a vehicle. Bolts and nuts 50 are placed through openings 51 in the arms and connected to the frame or bumper of a vehicle. The support system also includes a mount member 48 connected by welding to the mating support means 44. The mount member 48 is slideably engaged into the receiver mount 72. Wing bolt 54 is used to removably fix the mount member 48 in the receiver mount 46.

A sleeve 70 is supported over a bolt 62 for guiding the hose 14 as the distal end is wound up on the hose holder 18. The bolt head 68 is on one side of number 20 and a nut 64 is secured to the bolt on the other side of the post. The sleeve 70 is held between a second nut 66 and the head of the bolt 68.

The sleeve 70 keeps the hose from riding on member 48 when the hose holder 18 is placed in certain positions. As the last few feet of hose are being wound up or rolled up, the sleeve will be utilized to aid in providing a smooth uniform roll.

It should be noted that the sizes of the part may be changed to accommodate various size hoses and components. The hose holder 18 having dowels 18' and 18'' at approximately $2\frac{1}{4}$ inches apart can accommodate $1\frac{1}{2}$ to 3 inch hoses.

The instant invention has been shown and described herein in what is considered to be the most practical and preferred embodiment. It is recognized, however, the departures may be made therefrom within the scope of the invention and that obvious modifications will occur to a person skilled in the art.

What I claim is:

1. A hose roller device allowing the user to steer the device with either hand in any direction and to wind up a hose with the other hand, comprising:

a member having a generally vertically longitudinal center line and an upper portion with a generally transverse axle opening and a lower portion;

a hose holder including a generally U-shaped fork with unconnected ends and a closed end, and an axle connected at one end to said closed end, said fork and said member constructed and arranged to allow a hose to be rolled up and quickly removed;

a bearing surface in said axle opening;

said axle positioned for rotation on said bearing surface in said axle opening;

said hose holder constructed, arranged and positionable about a portion of a collapsed hose to wind the hose over said hose holder from any outlying position, whereby the user can easily rotate the member into any position in the three hundred and sixty degrees to roll up hose lying outward in any of a plurality of directions;

said hose and said portion of a collapsed hose movable off of said hose holder in a direction parallel to said axle without obstruction even after the collapsed hose is completely rolled up into a roll;

said member includes a support means;

said member is positioned for rotatable movement about said longitudinal center line and supported on said support means, and a tiller means connected to said member, said tiller means extending generally outward from said member, said tiller means for steering said hose holder and said member with one hand to position said axle generally at ninety degrees to the longitudinal center line of the adjacent hose to lay the collapsed hose about to be rolled up evenly on said fork of said hose holder by rotating said axle with the other hand of the user.

2. A hose roller device allowing a user to roll hose lying outward in any direction from this device, comprising:

a member having a vertical longitudinal center line and an upper portion with a transverse axle opening and a lower portion;

a hose holder including a fork with unconnected distal ends and a closed end, an axle connected at one end to said closed end, and a bearing surface positioned in said axle opening, said axle positioned for rotation in said axle opening; said member constructed and arranged with said fork being the sole structure radially for the radius of a rolled up hose and outwardly in the direction of said distal ends from said closed end, a drive means connected to the other ends of said axle;

said member includes a support means connected to said member and positioned above said lower portion;

said member constructed, arranged and generally positioned vertically for three hundred and sixty degree rotation about said longitudinal center line, whereby the user can easily rotate the member into any position in the three hundred and sixty degrees to roll up hose lying outward in any of a plurality of directions;

said member supported on said support means, and a support system including a mating support means with a mating support surface and an opening in said mating support means for passage of said lower portion beneath said mating support surface;

said support system includes a permanent receiver mount connectable to a vehicle, a mount member connected to said mating support means and slideable into said receiver mount, and means to position said mating support means in said receiver mount, said mating support means of a length for allowing said fork and said drive means to be usable in all positions in said three hundred and sixty degrees of movement;

said hose holder constructed, arranged and positionable about a portion of a collapsed hose to wind the hose over said hose holder;

said hose and said portion of said collapsed hose movable off of said hose holder in a direction parallel to said axle without obstruction even after the collapsed hose is completely rolled up into a roll;

a tiller means connected to either side of said member and projecting transversely outward in either direction for steering said hose holder and said member through said three hundred and sixty degrees of movement with one hand to position said axle generally at ninety degrees to the longitudinal center line of the adjacent hose to lay the collapsed hose about to be rolled up evenly on said fork of said hose holder by rotating said axle with the other hand of the user.

* * * * *